US006705921B1

(12) United States Patent
Shepherd

(10) Patent No.: US 6,705,921 B1
(45) Date of Patent: Mar. 16, 2004

(54) METHOD AND APPARATUS FOR CONTROLLING CUTTING TOOL EDGE CUT TAPER

(76) Inventor: John D. Shepherd, 13822 Bruns Rd., Manhattan, IL (US) 60442

( * ) Notice: Subject to any disclaimer, the term of this patent is extended or adjusted under 35 U.S.C. 154(b) by 0 days.

(21) Appl. No.: 10/237,766

(22) Filed: Sep. 9, 2002

(51) Int. Cl.[7] ..... B24D 49/00

(52) U.S. Cl. ..... 451/2; 451/5; 451/8; 451/9; 451/75; 451/86; 451/91; 451/102; 408/180; 408/187

(58) Field of Search ..... 451/2, 5, 8, 9, 451/75, 86, 91, 102; 408/180, 187

(56) References Cited

U.S. PATENT DOCUMENTS 4,669,760 A 6/1987 Hashish et al.
4,854,091 A 8/1989 Hashish et al.
4,936,059 A 6/1990 Hashish et al.
5,255,853 A 10/1993 Munoz
5,653,560 A * 8/1997 Weber et al. ..... 408/1
5,759,086 A 6/1998 Klingel
6,126,524 A 10/2000 Shepherd
6,578,636 B2 * 6/2003 Mazorow et al. ..... 166/298

OTHER PUBLICATIONS

"Hydrocut Water Jet Cutting Machine", the title pages and pp. 2–4, 2–5, 2–7, 2–8, 2–12, 4–29, 4–30 and 6–24 through 6–26 of ESAB Cutting Systems manual No. F14–135 dated May, 1999.

* cited by examiner

*Primary Examiner*—Joseph J. Hail, III
*Assistant Examiner*—Shantese McDonald
(74) *Attorney, Agent, or Firm*—Greer, Burns & Crain, Ltd.; Philip M. Kolehmainen

(57) ABSTRACT

A tilt control assembly for controlling the tilt of a cutting tool head has a first eccentric support and a second support, with both of the first and second supports connected to the head along an axis of the head. To adjust the position of the head, the first eccentric support may be rotated.

20 Claims, 4 Drawing Sheets

21
48
144
148
100
22
20
102
16
23
18
116
26
142
112
146
108
128
138
46
4
4
104
106
147
114
115
110
132
134
118
140
130
136
152
26
28
34
32
158B
158A
162
164
168
160
158

METHOD AND APPARATUS FOR CONTROLLING CUTTING TOOL EDGE CUT TAPER

FIELD OF THE INVENTION

The present invention relates to methods and apparatuses for orienting a cutting tool. More particularly, the present invention relates to methods and apparatuses for controlling, reducing or eliminating the tapered edge that results when a workpiece is cut with a cutting tool.

BACKGROUND OF THE INVENTION

Cutting tools for cutting workpieces are generally known, with examples including drills and the like. One particular genre of cutting tools is non-contact cutting tools. Typically these tools emit a high energy stream towards a workpiece to cut the workpiece. Examples of such non-contact cutting tools include laser tools, torches such as an acetylene torch, plasma cutting tools, and high pressure waterjets.

Taking waterjet systems as exemplary of non-contact cutting tools, a typical waterjet system includes a waterjet head that is supplied with liquid at an ultra high pressure (UHP), for example 10,000 to 60,000 pounds per square inch (psi). The UHP liquid is discharged in an axial direction from the head in a high velocity stream against the workpiece. The liquid stream is used to cut through materials such as wood, metal, paper and foam. An abrasive particulate material can be added to the stream, and the liquid/abrasive stream can be used to cut through composites, metals and other dense materials. The cutting stream typically is concentrated in a small area that may be for example about 0.05 inch diameter, and has a high flow rate of for example about one to three gallons per minute (gpm). With commonly available equipment, the waterjet head and the cutting stream are maintained perpendicular to the top surface of the workpiece and are moved by a computer numerically controlled (CNC) system in order to cut through the workpiece along a cut line.

Although non-contact cutting tools such as waterjet systems have many advantages, an unfortunate result of making a cut with such a tool can be the taper of the cut edge. In most instances it would be desirable for the finished edge to have no taper and to be in a plane perpendicular to the workpiece top surface. However, the non-contact cutting stream, such as the water stream, may produce an edge that is inclined or tapered. The cutting stream may remove more material at the top than at the bottom of the cut, and in this case the resulting cut edge has what can be termed a positive taper. Referring particularly to waterjet systems by way of example, the amount of the taper is dependent on many variables including the speed at which the waterjet head is moved along the workpiece surface. At very slow speeds a relatively taper-free or a negatively tapered edge can be formed. Slower cutting speeds, however, increase production times and are disadvantageous.

A prior art waterjet cutting system designated as a whole as 10 is shown in FIG. 1. The system 10 is used to form a cut 12 in a workpiece 14, and includes a waterjet head assembly 16. The waterjet head 16 includes a valve body 18 operated to open or closed positions by an actuator 20 controlled remotely by the presence or absence of pressurized air supplied to the actuator 20 through an air control conduit 22. Ultra high pressure (UHP) liquid is supplied to the waterjet head 16 from a suitable UHP pump system 21 at pressures of between about 10,000 and 60,000 PSIG through a UHP liquid supply conduit 23 normally formed of stainless steel and having sufficient flexibility to permit movement of the waterjet head 16 around the surface of the workpiece 14.

A valve nut 24 attaches a tube 26 to the bottom of the valve body 18. When the valve in the valve body 18 is opened by the application of pressurized air within the actuator 20, UHP liquid flows downward through the valve body 18 and the tube 26 to an outlet nozzle assembly 28 including a mixing chamber housing 30 and a nozzle 32. The nozzle 32 is aligned with the longitudinal axis of the waterjet head 16, and includes an axial discharge passage through which a concentrated UHP liquid stream is discharged at high pressure and high velocity.

For many applications, fine particles of an abrasive material such as garnet are added to the liquid stream. The mixing chamber member 30 receives particulate abrasive through a flexible rubber or neoprene abrasive supply line 34. When UHP liquid flows through the mixing chamber member 30, abrasive material is entranced in the liquid stream and a liquid/abrasive stream having increased cutting capability is discharged from the nozzle 32.

The waterjet head 16 is supported, typically with its axis vertical and perpendicular to the top surface 38 of the workpiece 14, by a clamp 36 or similar fixture. The clamp 36 is carried by a support arm 40 extending from a clamp plate 42 attached to a front plate 44 of a support member or lift 46. The lift 46 is moved in three orthogonal directions by a three axis X-Y-Z drive 48. Typically the drive 48 can move the waterjet head 16 in an X direction from side to side over the workpiece 14 and, separately or simultaneously, in a Y direction forward and rearward over the workpiece 14. The drive 48 can also move the head 16 in a Z direction, vertically with respect to the workpiece. A computer numerical control (CNC) system 50 controls the drive 48 to perform a cutting operation upon the workpiece 14. The head is moved in the Z direction to place the outlet of the nozzle 32 near the top workpiece surface 38. Then the control system moves the head 16 in the X and/or Y directions to form the cut 12. Typically the control system 50 is programmed to cut the workpiece in selected straight and/or curved lines and/or corners to fabricate finished parts having a desired shape.

Prior art waterjet systems of the type seen in FIG. 1 are commercially available from sources including EASE Cutting Systems, 411 Ebenezer Road, Florence, S.C. 29501-0504. A further description of the prior art system 10 can be found at the title pages and pages 2–4, 2–5, 2–7, 2–8, 2–12, 4–29, 4–30 and 2–24 through 6–26 of ESAB Cutting Systems manual No. F14-135 dated May, 1999, filed herewith and incorporated herein by reference. A further description of a prior art waterjet head can also be found in U.S. Pat. No. 6,126,524 incorporated herein by reference.

When the cut 12 is formed in the workpiece 14 by the vertically disposed head 16, the sides of the cut 12 are defined by inclined, sloped walls 12A and 12B. These sloped walls form a tapered cut 12. The slope of the sides 12A and 12B of the tapered cut 12 can be as large as a several degrees. This taper can be undesirable, and in most operations a sidewall of the finished part that is perpendicular to the top surface 38 would be preferred. In some operations, a taper different from that of sides 12A and 12B would be preferred, for example to provide a beveled edge.

It would be desirable to control the taper of the cut edge so that taper could be reduced or eliminated or, alternatively, so that a controlled beveled edge of a desired angle could be produced. It has been recognized that positive taper can be reduced by slowing the cutting speed of the waterjet head. This practice, however, adds to manufacturing time and cost. In addition, expensive five-axis tilt control assembly systems are available for providing tilt and rotation in addition to X-Y-and Z movement that may offer some degree of taper control. Known five axis systems, however, are costly, complex, and bulky. These and other factors are deterrents to their use.

A proposed solution for cut edge bevel control is shown in U.S. Pat. No. 5,199,342 to Hediger ("the '342 patent"). The system disclosed in the '342 patent generally discloses a waterjet nozzle movably held by an X-Y drive system at a first point, and with the nozzle end pivotably held. X-Y movement at the first point causes the nozzle to be oriented at an angle to a workpiece. The X-Y drive system moves the first connection point in a first frame, which is movably held on a second frame. While some degree of tilt is provided, the overall configuration of the system of the '342 patent entails a degree of complexity and cost that is undesirable.

Unresolved needs therefore remain in the art.

SUMMARY OF THE INVENTION

The present invention is directed to methods and apparatuses for controlling the taper of a workpiece edge cut by a cutting tool. A tilt control assembly of the invention includes a tilt control assembly body with first and second supports coupled to the body. Each of the first and second supports is connected to the head along an axis of the head. In a first exemplary tilt control assembly of the invention, the first support is eccentric and movably coupled to the tilt control assembly body. A drive is coupled to the first support and is operative to rotate the first head support and position the head at a selected angle to the workpiece. In a second exemplary tilt control assembly of the invention, both of the first and second supports are movable, and are coupled to a drive operative to rotate the first and second head supports and position the head at a selected angle to the workpiece. In a preferred embodiment of the apparatus of invention, both the first and second head supports are eccentric.

In still an additional aspect of the present invention, a method for positioning a cutting tool head is provided. An exemplary method comprises the steps of supporting a cutting tool head with first and second supports along an axis of the head, and moving both of the supports to position the head at a selected angle to the workpiece. Preferably, both the first and second supports are moved eccentrically.

Methods and apparatuses of the invention thereby provide advantages and solutions to problems of the prior art. For example, an apparatus of the invention that has two eccentric head supports provides compact and relatively inexpensive tilt control capabilities that can be used to control the taper of a cut edge over a wide range of taper or bevel angles. Additional advantages and aspects of the invention will be better understood through consideration of the detailed description of invention embodiments provided herein below.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION

Figure 1:
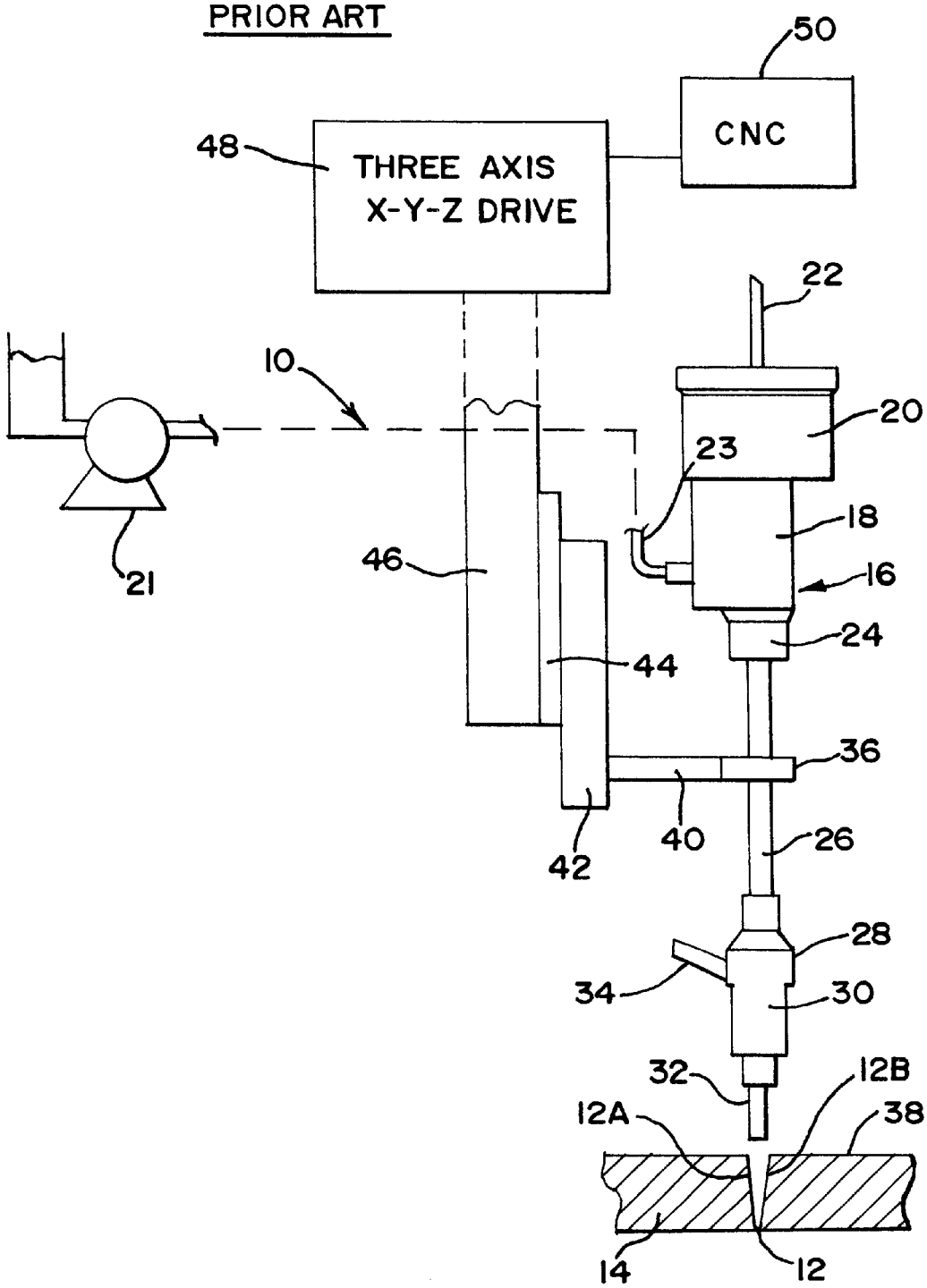
FIG. 1 PRIOR ART
FIG. 1 is a partly schematic, side elevational view of a prior art waterjet cutting system also showing in cross section a cut made by the system in a workpiece.
Figure 2:
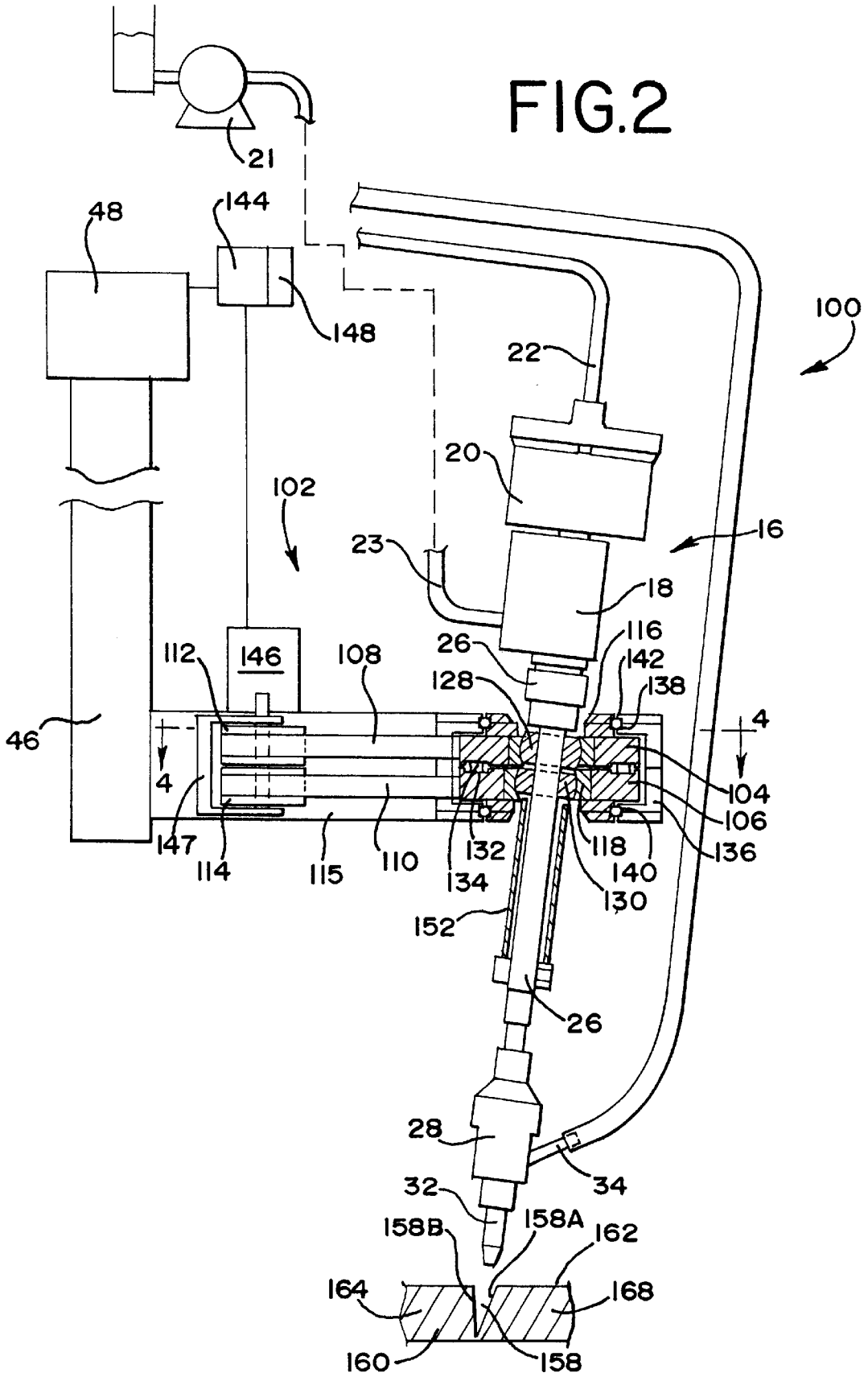
FIG. 2 is a partly schematic, side elevational view of a waterjet cutting system of the present invention showing partly in cross section a tilt control assembly of the invention, and also showing in cross section a cut in a workpiece made by performing the method of the present invention.

Having reference now to the drawings, FIG. 2 shows a waterjet cutting system in accordance with the present invention, generally designated as 100. An advantage of the invention is that it can incorporate many of the components of a standard, prior art system such as that seen in FIG. 1, and therefore is relatively low in cost. In FIG. 2 and the other figures of the drawings, the same reference characters are used for components of the system 100 that are in common with the system of FIG. 1, and the description of these common components is not repeated except where helpful to an understanding of the invention.

Figure 4:
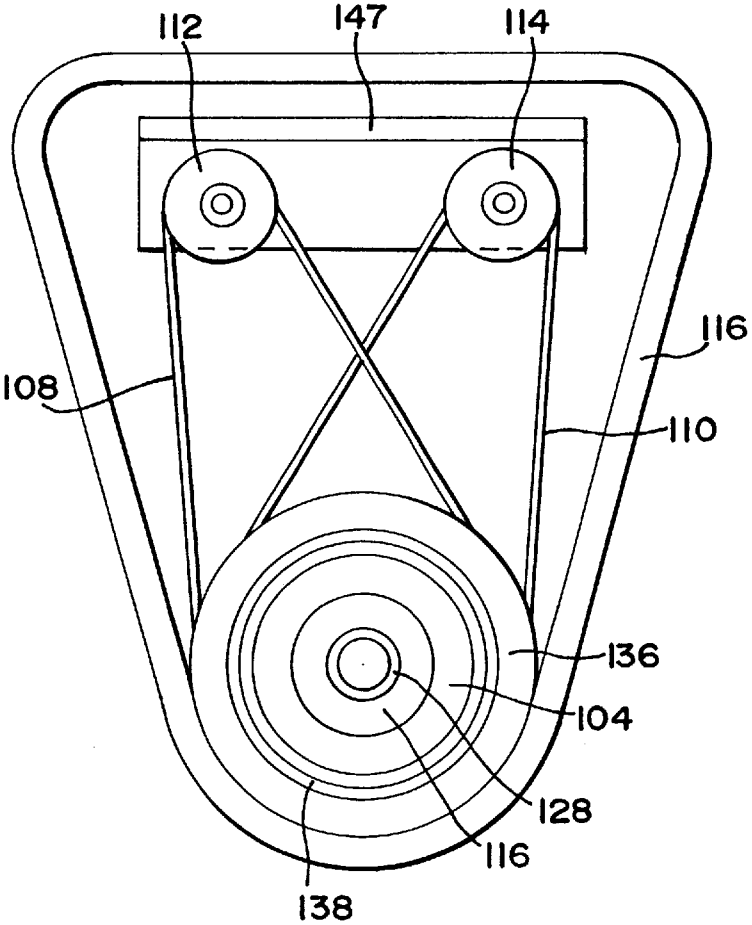
FIG. 4 is a cross section top view of the tilt control assembly of FIG. 2 viewed generally along the line 4—4 of FIG. 2.

In the system 100, a tilt control assembly shown generally at 102 (partly in cross section), is provided for selectively positioning the jet head 16 at an angle to the workpiece 160. The tilt control assembly 102 includes first and second eccentric head supports 104 and 106 (shown in cross section in FIG. 2) that are disposed along an axis of the jet head 16. More specifically, the eccentric supports 104 and 106 are connected to the tube 26 along its axis. Each of the eccentric supports 104 and 106 is connected by a drivebelt 108 and 110, respectively, to a respective drive wheel 112 and 114. The top view of the tilt control assembly 102 shown in FIG. 4 better illustrates the placement of the drive wheels 112 and 114. The supports 104 and 106, as well as the drive wheels 112 and 114 are all coupled to a tilt control assembly body 115 that is connected to the lift 46. Through rotation of the eccentric supports 104 and 106, the jet head 16 may be positioned at a desired degree of tilt.

In the preferred tilt control assembly 102, the eccentric head supports 104 and 106 are in the form of eccentric gears optionally having formations such as teeth or the like on their perimeter (not illustrated) for cooperating with the drive belts 108 and 110. The gears 104 and 106 are preferably constructed of a material selected for cost, durability, and the like, and may be stock items available from hardware supply vendors such as the McMaster Carr Corp., 600 County Line Road, Elmhurst, Ill. ("McMaster Carr"). As best illustrated by the cross section of FIG. 3, the preferred eccentric gears 104 and 106 have an inner bearing housing 116 and 118 fixedly held in their eccentric throughbores 120 and 122, respectively. The bearing housings 116 and 118 may be fixedly held in the eccentric throughbores 120 and 122 by friction, adhesive, fasteners such as a screw, bolt, or pin, or the like. Each of the bearing housings 116 and 118 has a respective throughbore 124 and 126 with the shape of a spherical segment. A spherical bearing 128 and 130 is tiltably held in each of the throughbores 124 and 126. The bearings 128 and 130 each have a respective tube receiving passage 131 and 133 for receiving the tube 26 of the jet head.

Figure 3:
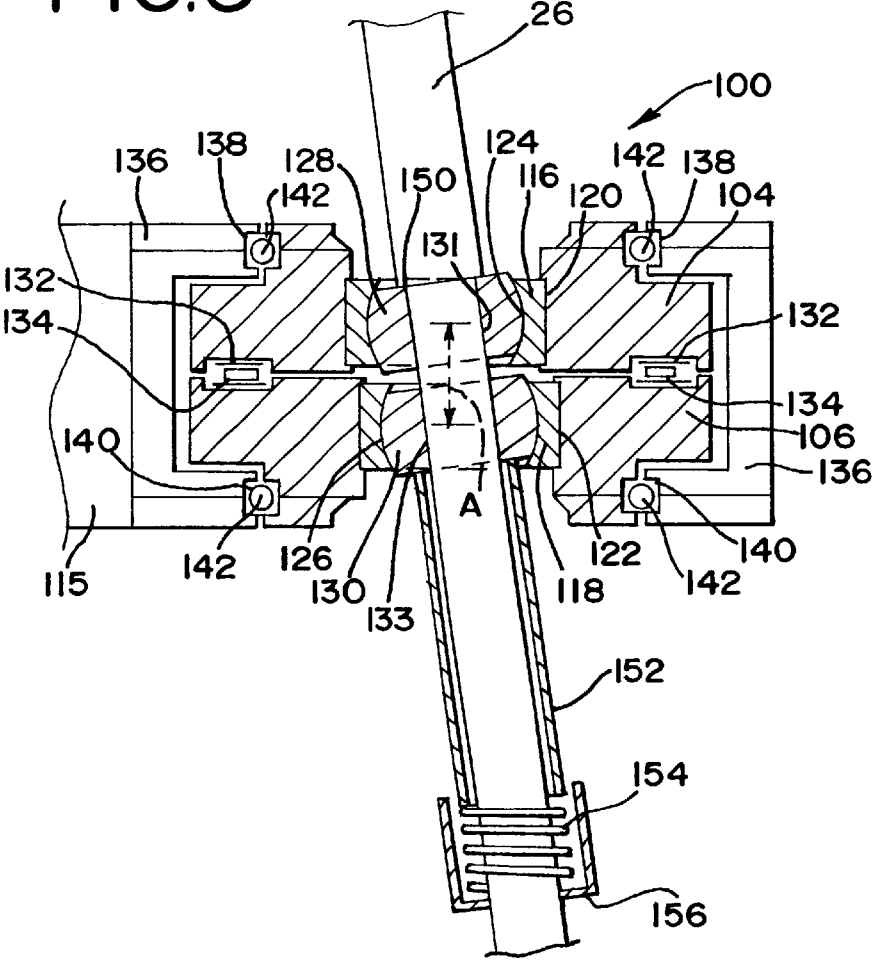
FIG. 3 is an enlarged cross section of a portion of the tilt control assembly and a portion of the nozzle shown in FIG. 2.

The bearings 128 and 130 preferably have a shape adapted to cooperate with the shape of the bearing housing throughbores 124 and 126, such as the cooperating spherical convex/concave shapes illustrated in FIG. 3. The cooperating shapes preferably allow for snap fitting of the bearings 128 and 130 into the bearing housings 116 and 118, while allowing for tilt and rotational movement. The bearings 128 and 130 may be constructed of materials selected for strength, cost, low friction, and like factors. An exemplary material of construction is Delrin. The bearings 128 and 130 along with the bearing housings 116 and 118 may be available from stock supply at hardware vendors such as McMaster Carr.

A first bearing race 132 is defined between the eccentric gears 104 and 106 with a roller bearing assembly 134 movably held therein to facilitate rotation of the two gears 104 and 106 relative to one another. The roller bearing assembly 134 is preferably suitable to facilitate simultaneous rotation of the gears 104 and 106 in opposite directions. As will be appreciated by those knowledgeable in the art, suitable roller bearing configurations are known. An example preferred roller bearing 134 configuration comprises a plurality of roller bearings held in a cage or the like and sandwiched between upper and lower washers that contact the race 132, and is available from McMaster Carr as a "Needle-Roller Thrust Bearing Assembly."

The gears 104 and 106 are movably retained in a bracket 136. Second and third bearing races 138 and 140 are defined between the bracket 136 and the eccentric gears 104 and 106. A plurality of ball bearings 142 are rotatably held in the races 138 and 140 to facilitate rotation of the gears 104 and 106 relative to the bracket 136.

Referring once again to FIG. 2 in addition to FIG. 3, the first and second eccentric gears 104 and 106 may be rotated through action of the drive wheels 112 and 114 and drive belts 108 and 110 to orient the head 16 at a desired angle to the workpiece 160. The limits of orientation depend on factors that include the degree of eccentricity (i.e., the distance from the center of the gear that the eccentric throughbore 120 and 122 is centered), and the vertical spacing of the supports 104 and 106 from one another. As shown by FIG. 2, a tilt controller 144 in combination with a tilt motor 146 are provided to selectively rotate each of the drive wheels 112 and 114. The drive wheels 112 and 114 may be rotatably supported on a bracket 147, and may be provided with formations such as gear teeth about their perimeter for cooperating with the drive belts 108 and 110. The tilt motor 146 may be a DC stepper motor connected to the tilt assembly body 115. The drive wheels 112 and 114 can be rotated independently of one another. Two motors 146 are provided, with one motor 146 linked to each of the drive wheels 112 and 114. Although only a single motor 146 has been illustrated in FIG. 2, it will be appreciated that a second motor 146 is generally behind the first as depicted in that FIG.

In order to properly orient the eccentric supports 104 and 106, the tilt controller 144 may be provided with predetermined positioning data, an algorithm, or other like data or logic for specifying what rotational position each of the supports 104 and 106 must be in to achieve a desired head 16 angle. The tilt controller 144 may be linked to the X-Y-Z drive 48, so that tilt of the head 16 can be accomplished in cooperation with X-Y-Z movement. Additionally, a sensor 148 (FIG. 2) may further be provided for sensing X-Y-Z movement of the head 16 from the X-Y-Z drive 48 or from other input. The sensor 146 may specify a desired tilt angle based on X-Y-Z movement if, for instance, a constant bevel edge is desired on a workpiece 160 being cut as the head 16 is moved along a desired X-Y cutting path on the workpiece 160.

It will be appreciated that the tilt controller 144 and/or the sensor 148 may be functionally integral with one another, and may further be functionally integral with the tilt motors 146. As used herein, the tilt motors 146, the tilt controller 144, and the sensor 148 may be generally referred to individually or collectively for convenience as a "tilt drive". Accordingly, it will be understood that a "tilt drive" as used herein broadly refers to one or more functional components that generally include one or more tilt motors such as the motor 146 for driving rotation of the eccentric supports 104 and 106 in addition to a tilt controller such as controller 144 for determining or specifying the degree of rotation of the supports 104 and 106 required to achieve a desired angle of head 116 tilt. A tilt drive may further include a sensor 148 or other sensing or position calculating capability internal to the controller 144 and/or the X-Y-Z drive 48.

Those knowledgeable in the art will appreciate that other drive systems for rotating the eccentric supports 104 and 106 may be provided as alternatives to the drive wheels 112 and 114 and drive belts 108 and 110. For example, a direct worm or gear drive system may be used. In such an embodiment, the eccentric supports 104 and 106 are driven directly by the worm or gear drive. Selection of a particular drive system will depend on factors such as cost, size, degree of precision of movement required, and the like. It is believed that a worm gear drive, for example, may offer some benefits in terms of compactness over the drive wheel and drive belt configuration illustrated in FIG. 2 and FIG. 4.

Those knowledgeable in the art will appreciate that a wide variety of applications for tilt control assemblies of the invention exist, and that different ranges of angles of orientation will be desirable for different applications. An exemplary orientation range is between about 0° (i.e., vertical) and about 45°. In one configuration suitable to achieve a substantially vertical orientation, the two supports 104 and 106 are substantially axially aligned with one another, and are equally eccentric (i.e., throughbore located equal distance off center on each support). It is believed that for a typical non-contact cutting tool, an axial separation distance shown as distance A in FIG. 3 (which is intended to represent the distance between the axial centerlines of the first and second eccentric supports 104 and 106) of about 1 in. or less, and a degree of eccentricity of less than about 0.1 in. (i.e., the eccentric throughbores 120 and 122 centered about 0.1 in. or less from the center point of the respective gears 104 and 106) will be useful.

In an exemplary waterjet cutting tool of the invention, the tilt control assembly 102 is suitable to orient the head 16 at an angle of between about 0° and about 9°. In order to achieve this range, two substantially identical eccentric supports 104 and 106 are provided with eccentric throughbores 120 and 122 centered about 0.055 in. off center of the gears 104 and 106 (i.e., eccentric by about 0.055 in.), and with a distance of about 0.75 in. separating the axial centerlines of the two eccentric gears 104 and 106 (i.e., the distance A of FIG. 3 equal to about 0.75 in.). With these dimensions, when the throughbores 120 and 122 are oriented in line with one another, the head 16 is substantially vertical. When the throughbores 120 and 122 are oriented at about 180° from one another with these preferred dimensions, a maximum tilt of about 9° is achieved.

As the jet head 16 is tilted at various angles, the tube 26 may move with respect to one or both of the eccentric gears 104 and 106. For example, when the eccentric gears 104 and 106 are rotated from an aligned position to their maximum tilt, the tube 26 will move in an axial direction through one or both of the bearings 128 and 130. Accordingly, the present invention contemplates allowing for some degree of movement of the tube 26 through the bearings 128 and 130. The need for tube 26 movement, however, should be balanced against a need for restraining the tube 26 from excessive slippage when a high-pressure jet stream is being ejected from the head 16. As illustrated by FIG. 3, a shoulder 150 is provided in the preferred waterjet 100 to engage the bearing 128. To allow for a limited degree of axial movement of the tube 26 through the bearings 128 and 130, a movable sleeve 152 is provided for engaging the bearing 130. The sleeve 152 is urged by a biasing spring 154 into engagement with the bearing 130, and has a maximum degree of slippage limited by an annular stop 156 that supports the spring 154. Alternatives to the biasing spring 154 are available for urging the sleeve 152 into engagement with the bearing 118. For example, it is believed that a compressible foam element may provide advantages over a spring in terms of cost.

In addition to apparatuses, the present invention is also directed to methods for controlling the bevel of an edge of a workpiece cut by a non-contact cutting tool. In considering methods of the invention, it will be appreciated that the methods may comprise steps of using a tilt control apparatus or a non-contact cutting tool of the invention. Accordingly, it will be appreciated that the FIGS. 2–4 and the description made herein with regards to those figures may be useful for description of methods of the invention in addition to an apparatus.

Figure 5:
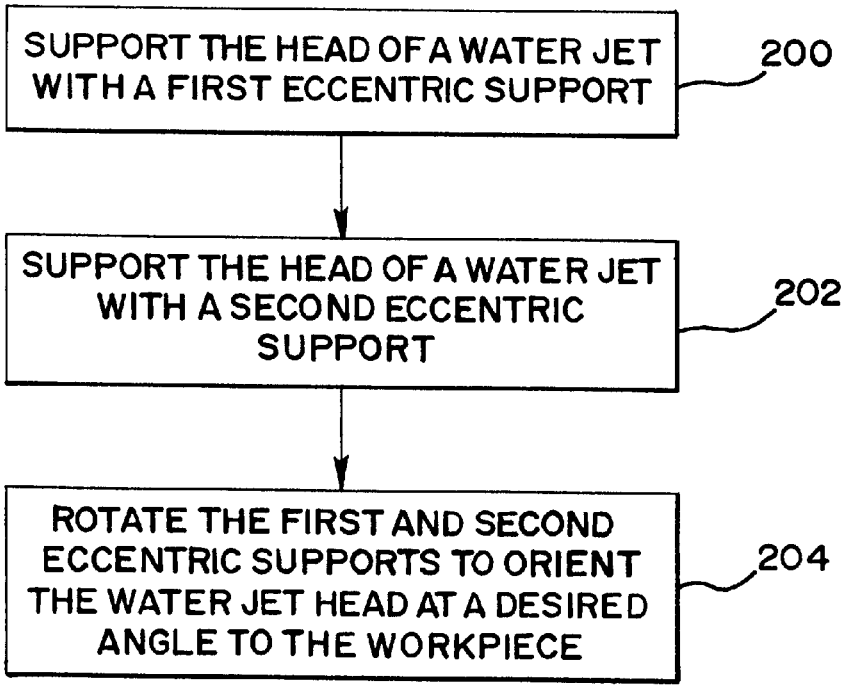
FIG. 5 is a flowchart illustrating steps of a method for controlling the taper of a workpiece cut by a non-contact cutting tool.

FIG. 5 is a flowchart illustrating the steps of a method of the invention. The head of a non-contact cutting tool is supported with a first eccentric support (block 200). An additional step of supporting the head with a second eccentric support along an axial line of the head is performed (block 202). To orient the head at a desired angle, the first and second eccentric supports are then rotated (block 204).

With the general method description of FIG. 5 now having been made, a more detailed exemplary method of the invention directed to controlling the bevel of an edge cut may be illustrated through consideration of the workpiece 160 of FIG. 2. In accordance with this method of the invention, steps are provided for using the tilt control assembly 102 to control the taper of the finished edge resulting from the cut 158 in the workpiece 160. The cut 158 is defined on one side by an edge 158A and on the other side by an opposed edge 158B. In FIG. 2, the portion of the workpiece 160 including the edge 158B is a finished part 164 severed from the workpiece 160 by the waterjet cutting operation. The tilt control assembly 102 maintains the waterjet head 16 tilted at a predetermined angle relative to a vertical line so that, in the arrangement of FIG. 2, the edge 158B of the finished part is generally perpendicular to the top surface 162.

Figure 6:
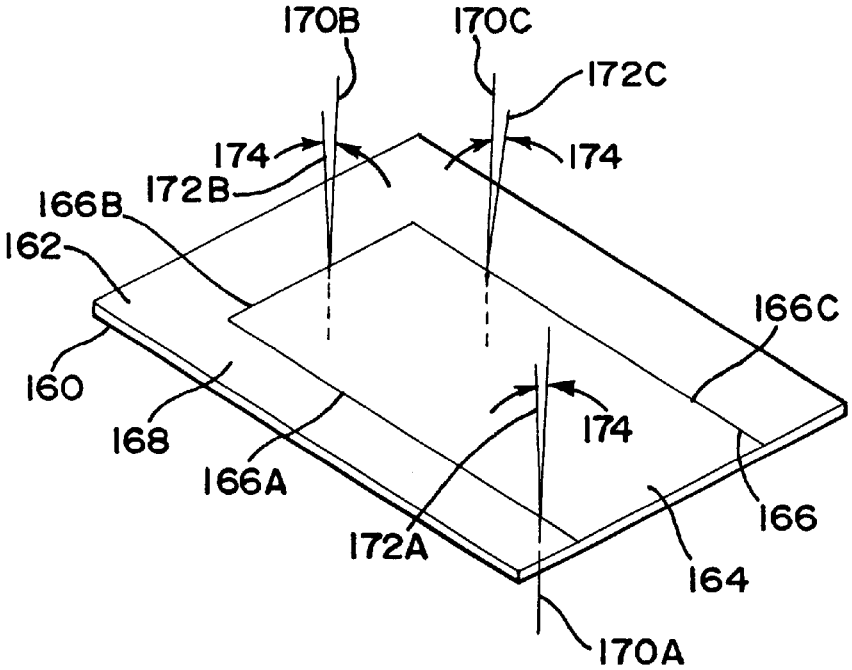
FIG. 6 is a schematic view illustrating an example of cutting a workpiece in accordance with the present invention.

A method of controlling the taper may be better illustrated through consideration of the schematic of FIG. 6. The workpiece 160 is cut along a line 166 seen on the top surface 162. The line 166 includes a first segment 166A extending in what can be termed a plus X direction, a second segment 166B extending in a Y direction and a segment 166C extending in a negative X direction. The X-Y-Z drive 48 moves the lift 46, the tilt control assembly 102, and the waterjet head 16 over the surface 162 to form the cut 158 through the workpiece along the line 166. The cut 158 along the line 166 severs the finished part 164 from the workpiece 160, leaving a scrap section 168 of the workpiece 160.

The tilt angle of the waterjet head 16 relative to a vertical line is selected so that the generally perpendicular cut edge 158B is achieved on the finished part side of the cut 158. The axis of the tilted waterjet head 16 and the vertical line are in a common tilt plane. The tilt control assembly 102 tilts the waterjet head 16 by rotating the supports 104 and/or 106 to achieve the perpendicular edge 158B along the entire length of the cut 158 extending along the line 166. The tilt control assembly 102 maintains the tilt plane at a constant bevel control angle relative to the direction of travel of the waterjet head 16.

More specifically, at one point in the line segment 166A, a vertical line 170A is drawn for reference. The axis of the waterjet head 16 when it intersects the line 170A is represented by a line 172A. The lines 170A and 172A form a tilt angle 174, and lie in a common tilt plane. Along the line segment 166A, this common tilt plane lies in the Y direction, perpendicular to the line segment 166A and to the direction of travel of the waterjet head 16 along the line segment 166A. In this example, the bevel control angle is ninety degrees.

When the moving waterjet head 16 completes the cut 158 along the line segment 166A and reaches the corner at the line segment 166B, the tilt control assembly 102 rotatably adjusts the positions of the supports 104 and 106 in order to place the tilt plane in the X direction and to maintain the tilt plane at the ninety degree bevel control angle to the line segment 166B and to the direction of travel of the waterjet head 16. At one point in the line segment 166B, a vertical line 170B is drawn for reference. The axis of the waterjet head 16 when it intersects the line 170B is represented by a line 172B. The lines 170B and 172B continue to form the tilt angle 174, and continue to lie in the common tilt plane. At the ninety degree comer where the line segment 166A meets the line segment 166B, the tilt control assembly 102 rotatably adjusts the supports 104 and 106 to maintain the constant ninety degree bevel control angle between the tilt plane and the direction of movement of the waterjet head 16.

At the ninety degree corner where the waterjet head 16 moves from the line segment 166B to the line segment 66C, the tilt control assembly 102 again rotates the supports 104 and 106 to keep the tilt plane at the constant bevel control angle, perpendicular to the direction of travel of the waterjet head 16. At one point in the line segment 166C, a vertical line 170C is drawn for reference. The axis of the waterjet head 16 when it intersects the line 170C is represented by a line 172C. The lines 170C and 172C continue to form the tilt angle 174, and continue to lie in the common tilt plane. The bevel control angle of ninety degrees relative to the direction of travel is maintained. The line 172C is inclined oppositely to the line 172A because the direction of travel of the waterjet head 16 along line segment 166C is opposite to the direction of travel along the line segment 166A.

The bevel control angle can be an angle different from ninety degrees if desired. The ninety degree angle is preferred because it minimizes the size of the tilt angle 174 required to obtain the perpendicular finished edge 158B. The size of the tilt angle needed to produce a perpendicular edge 158B depends on the material and thickness of the workpiece, the speed of movement of the waterjet head 16 and other factors. The tilt angle for a particular job can be determined by experimentation with trial runs or by past experience. The line 166 seen in FIG. 6 includes straight line segments and sharp ninety degree comers. However, the invention is applicable to any cutting line including curved line segments, radiused corners and any other shapes. Regardless of the configuration of the path, the tilt control assembly 102 can operate to maintain a constant bevel control angle.

Also, the tilt angle is chosen to achieve the edge orientation that is desired. FIG. 2 illustrates the tilt angle selected to achieve an edge 158B that is perpendicular to the top surface 162. A smaller angle or a tilt in the opposite direction may be selected to achieve a positive beveled edge. A larger angle may be selected to achieve a reverse or negative beveled edge. The bevel control angle can be varied along the path of cutting if a non-uniform edge is desired, for example, beveled on one portion of the finished part and perpendicular on another portion.

Methods and apparatuses of the present invention thereby provide an elegant and effective solution to many otherwise unresolved problems of the prior art. For example, a tilt control assembly of the invention is a relatively compact and inexpensive system that can be used to achieve a wide range of desired tilt angles for non-contact cutting tools. Similarly, a method of the invention can be used to control the tilt of a non-contact cutting tool to effectively control the bevel of a workpeice cut in a relatively simple and inexpensive manner.

Those knowledgeable in the art will appreciate that discussion of preferred and exemplary embodiments of the present invention has been made herein for purposes of illustrating the known best modes of practice of the invention, but that many other invention embodiments may be practiced. By way of example, although preferred embodiments of the invention are directed to a tilt control assembly for use with a non-contact waterjet cutting tool, the invention may be useful with other non-contact cutting tools, and with contact cutting tools such as drills and the like. With reference to preferred invention embodiments for practice with non-contact cutting tools, it will be appreciated that the invention may be useful when practiced with non-contact cutting tools other than waterjets, with lasers, plasma cutters and torches as examples.

Further, although invention embodiments have been illustrated that include two eccentric supports, other invention embodiments may utilize other combinations of different types of supports. By way of example, a single eccentric support with a second, non-moving pivotal support may prove useful for some applications. Also, a single eccentric support with a second movable, but non-eccentric, support (e.g., X movable only) may prove useful for other applications. By way of still further example, although apparatuses have been illustrated with supports disposed generally vertically from one another, other invention embodiments may have supports oriented in a generally horizontal direction. Accordingly, description herein of exemplary invention embodiments should not be taken to limit the scope of the appended claims.

What is claimed is:

1. A tilt control assembly for controlling the taper of a work piece edge cut by a cutting tool having a head with an axis, the tilt control assembly comprising:

a tilt control assembly body;

a first head support movably coupled to said tilt control assembly body and a second head support coupled to said tilt control assembly body, said first head support being eccentric, said first head support and said second head support each connected to the head along the head axis, said first head support rotatable relative to said second head support; and a tilt drive coupled to said first head support, said tilt drive operative to rotate said first head support relative to said second head support and position the head at the selected angle to the workpiece.

2. A tilt control assembly as defined by claim 1 wherein said second head support is movably coupled to said tilt control assembly body, and wherein said tilt drive is coupled to said second head support independent from said first head support and operative to rotate said second head support independently of said first head support.

3. A tilt control assembly as defined by claim 1 wherein said second head support is movably coupled to said tilt control assembly body and is eccentric, and wherein said tilt drive is coupled to said second head support independent from said first head support and operative to rotate said second head support independently of said first head support.

4. A tilt control assembly as defined by claim 3 wherein said first head support and said second head support are substantially identical.

5. A tilt control assembly as defined by claim 3 wherein said first and second head supports are substantially in axial alignment with one another.

6. A tilt control assembly as defined by claim 1 wherein said drive is operative to position the head at an angle of between about 0° and about 45° relative to a plane of the workpiece.

7. A tilt control assembly as defined by claim 1 wherein said first head support comprises an eccentric gear having a perimeter, at least a portion of said perimeter having gear teeth cooperating with a linkage to said drive.

8. A tilt control assembly as defined by claim 1 wherein said tilt drive comprises a worm drive.

9. A tilt control assembly as defined by claim 1 wherein said tilt drive is operative to drive at least a first drive wheel coupled to said first head support by a drive belt.

10. A tilt control assembly as defined by claim 1 wherein the cutting tool head is movable in X-Y directions, and wherein said tilt drive further comprises an X-Y movement sensor, said sensor operative to cause said tilt drive to adjust said first head support in response to X-Y movement of the cutting tool head.

11. A non-contact cutting tool including the tilt control assembly as defined by claim 1, and further comprising:

a head nozzle;

a movable support engaging sleeve disposed along said nozzle; and a spring operative to urge said sleeve into engagement with one of said first or second supports.

12. A tilt control assembly for controlling the taper of a workpiece edge cut by a non-contact cutting tool having a head with an axis, the head movable in X-Y directions, the tilt control assembly comprising:

a tilt control assembly body;

first and second head supports movably coupled to said tilt control assembly body and connected to the head along the head axis;

a tilt drive coupled to each of said first and second head supports, said tilt drive operative to move said first and second head supports relative to said tilt control assembly body and position the head at an angle to the workpiece, said tilt drive including an X-Y movement sensor operative to cause said tilt drive to move said first and second supports in response to X-Y head movement to control the taper of the cut.

13. A method for controlling the taper of an edge cut by a cutting tool head, the method comprising the steps of:

supporting the head with first and second movable supports, said first and second supports disposed along the axis of the head, at least said first support being eccentric, said first support and second supports being independently movable relative to one another and rotating said first and second supports independently of one another to position the head at a selected angle to the work piece.

14. A method for controlling the taper of an edge as defined by claim 13, wherein said first and second supports are eccentric, and wherein the step of moving said first and second supports comprises rotating said first support in a clockwise direction, and rotating said second support in a counter-clockwise direction.

15. A method for controlling the taper of an edge as defined by claim 14 wherein each of said first and second supports has a centerline, wherein said first and second eccentric supports are spaced vertically from one another with said centerlines separated from one another by a distance of about 1 in. or less, and wherein said first and second eccentric supports are eccentric by about 0.1 in. or less.

16. An apparatus for directing an ultra-high pressure waterjet at a workpiece to operate on the workpiece at a desired angle, the apparatus comprising:

an ultra-high pressure water pump system operative to supply water at a pressure of at least 10,000 PSIG;

a jet delivery head communicating with said ultra-high pressure water pump system, said jet delivery head having an axis;

an X-Y-Z drive connected to a lift and operative to move said lift in X-Y-Z directions;

a tilt control assembly body movably attached to said lift;

first and second eccentric head supports coupled to said tilt control assembly body, each of said first and second eccentric head supports spaced vertically from one another, each of said first and second eccentric head supports connected to said head along said axis; and a tilt drive independently linked to each of said first and second eccentric head supports, said tilt drive operative to rotate said first and second eccentric head supports to orient said head at a selected angle to the workpiece.

17. A tilt control assembly for controlling the taper of a work piece edge cut by a cutting tool having a head with an axis, the tilt control assembly comprising:

a tilt control assembly body;

a first head support movably coupled to said tilt control assembly body and a second head support coupled to said tilt control assembly body, said first and second head supports being eccentric by about 0.1 in. or less, said first and second head supports having centerlines that are axially spaced from one another by a distance of about 1 in. or less, said first head support and said second head support each connected to the head along the head axis, said second head support movably coupled to said tilt control assembly body; and a tilt drive coupled to said first head support and to said second head support, said tilt drive operative to rotate said first head support, to rotate said second head support and to position the head at the selected angle to the work piece.

18. A tilt control assembly for controlling the taper of a work piece edge cut by a cutting tool having a head with an axis, the tilt control assembly comprising:

a tilt control assembly body;

a first head support movably coupled to said tilt control assembly body and a second head support coupled to said tilt control assembly body, said first head support being eccentric, said first head support and said second head support each connected to the head along the head axis;

two bearings, one each of said two bearings movably retained in one each of said first and second head supports, each of said two bearings having a head receiving passage and being tiltable; and, a tilt drive coupled to said first head support, said tilt drive operative to rotate said first head support and position the head at the selected angle to the work piece.

19. A non-contact cutting tool having a head with an axis and including a tilt control assembly, the tilt control assembly for controlling the taper of a workpiece edge cut by the cutting tool head, the tilt control assembly comprising:

a tilt control assembly body;

a first head support movably coupled to said tilt control assembly body and a second head support coupled to said tilt control assembly body, said first head support being eccentric, said first head support and said second head support each connected to the head along the head axis;

a tilt drive coupled to said first head support, said tilt drive operative to rotate said first head support and position the head at the selected angle to the workpiece, a head nozzle having at least one support engaging shoulder; and said cutting tool head having at least one head nozzle with at least one support engaging shoulder.

20. A method for controlling the taper of an edge cut by a cutting tool head, the cutting tool head being movable in X-Y directions, the method comprising the steps of:

supporting the head with first and second movable supports, said first and second supports disposed along the axis of the head;

moving said first and second supports to position the head at a selected angle to the workpiece;

sensing X-Y movement of the cutting tool head; and moving said first support in response to X-Y movement to control the taper of the edge.

* * * * *